US005911585A

United States Patent [19]

Zwit

[11] Patent Number: 5,911,585

[45] Date of Patent: Jun. 15, 1999

[54] ELECTRICAL GROUNDING CONNECTOR WITH COMPRESSION CONDUCTOR CONNECTOR

[75] Inventor: Andrew T. Zwit, Noblesville, Ind.

[73] Assignee: Framatome Connectors USA, Inc., Fairfield, Conn.

[21] Appl. No.: 08/926,364

[22] Filed: Sep. 9, 1997

[51] Int. Cl.[6] ..... H01R 15/00

[52] U.S. Cl. ..... 439/100

[58] Field of Search ..... 24/271, 279, 282; 439/100, 777, 799

[56] References Cited

U.S. PATENT DOCUMENTS

| | | | |
|---|---|---|---|
| 3,985,411 | 10/1976 | Mooney et al. | 339/14 |
| 4,189,198 | 2/1980 | Reichman | 339/13 |
| 4,875,864 | 10/1989 | Campbell | 439/100 |

OTHER PUBLICATIONS

"Electrical Master Catalog, The Electrical Connector Selector", Framatome Connectors International, 1996, pp. D–7, D–10, D–12, N–22 and N–27.

*Primary Examiner*—Gary Paumen
*Assistant Examiner*—Alexander Gilman
*Attorney, Agent, or Firm*—Perman & Green, LLP

[57] ABSTRACT

An electrical grounding connector for connecting a conductor to a pipe. The connector comprises a band and an electrical compression connector. The band wraps around the pipe and has two ends that form an outwardly extending stem. The compression connector has two apertures. The compression connector is mounted to the band with the stem in a first one of the apertures. A conductor is received in the second aperture. The compression connector is compressed onto the stem and the conductor at the same time.

19 Claims, 3 Drawing Sheets

ELECTRICAL GROUNDING CONNECTOR WITH COMPRESSION CONDUCTOR CONNECTOR

BACKGROUND OF THE INVENTION

1. Field of the Invention

The present invention relates to electrical connectors and, more particularly, to a grounding connector with a compression connector.

2. Prior Art

U.S. Pat. No. 4,189,198 discloses a conduit ground wire coupling. The Burndy Electrical division of Framatome Connectors USA Inc. sells compression ground tap connectors known as the type YGHP-C.

SUMMARY OF THE INVENTION

In accordance with one embodiment of the present invention, an electrical grounding connector for connecting a conductor to a pipe is provided comprising a band and an electrical compression connector. The band is comprised of electrically conductive material adapted to wrap around the pipe. The band has two end sections that form an outward extending stem for the band. The electrical compression connector has at least two receiving apertures. A first one of the receiving apertures receives the stem therein for connecting the two end sections of the band to each other. A second one of the receiving apertures receives the conductor therein. The compression connector is compressed to fixedly attach the compression connector to the conductor and to the stem at the same time.

In accordance with another embodiment of the present invention, an electrical grounding connector is provided comprising a band and a one-piece electrical compression connector. The band is comprised of electrically conductive material having at least two band sections. The band sections are connectable to each other in series for wrapping around a first electrical conductor. The at least two band sections have mating stem halves that form a compression connector mounting section. The one-piece electrical compression connector is attached to the compression connector mounting section of the band to attach the stem halves to each other. The compression connector has an area for receiving a second electrical conductor. The compression connector can be compression onto the compression connector mounting section and onto the second electrical conductor at the same time.

In accordance with one method of the present invention, a method of attaching a first electrical conductor to a second electrical conductor is provided comprising steps of connecting first ends of two half band strips to each other and placing the strips around the first conductor; placing a one piece electrical compression connector on a stem formed by second ends of the strips; placing the second electrical conductor in a receiving area of the compression connector; and crimping the compression connector onto the stem and onto the second conductor.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
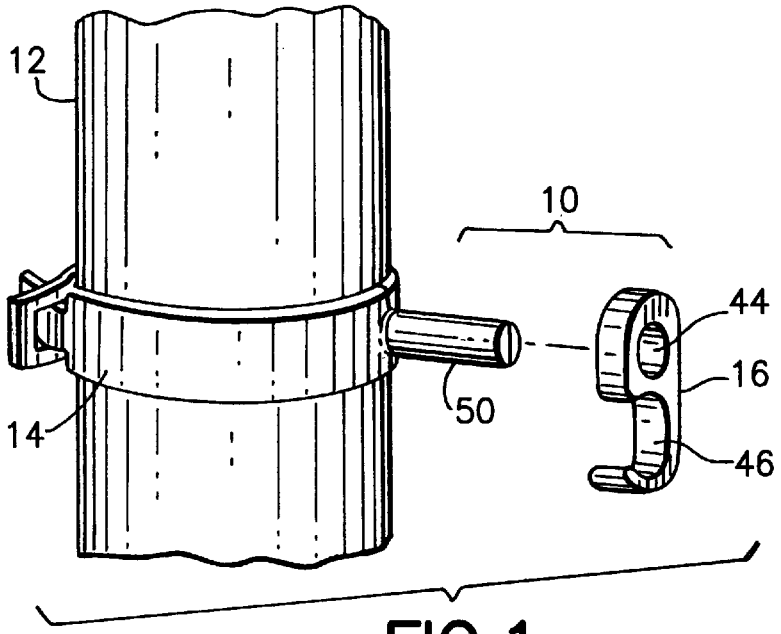
FIG. 1 is a perspective view of an electrical grounding connector incorporating features of the present invention attached to a pipe.

Referring to FIG. 1, there is shown a perspective view of an electrical grounding connector 10 incorporating features of the present invention attached to a pipe 12.

Although the present invention will be described with reference to the embodiments shown in the drawings, it should be understood that the present invention could be embodied in many different types of alternate embodiments. In addition, any suitable size, shape or type of elements or materials could be used.

Figure 2:
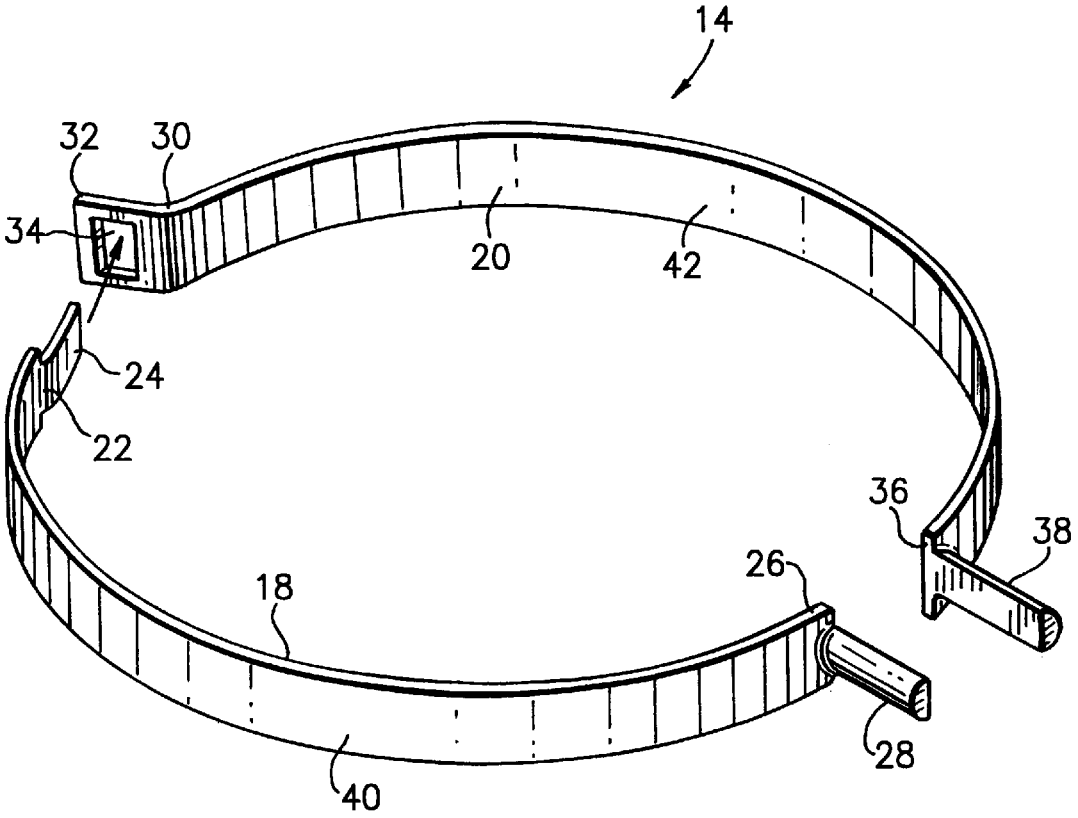
FIG. 2 is an exploded perspective view of the band used in the connector shown in FIG. 1.

The pipe 12 could be an electrical conduit, a water pipe, a gas pipe or any other pipe made of electrically conductive material and connected to ground. The connector 10 is intended to be used to connect a ground conductor 13 (see FIG. 5) to the pipe 12. The connector 10 generally comprises a band 14 and a compression connector 16. Referring also to FIG. 2, the band 14 is comprised of two half band sections 18, 20. Each band section is preferably comprised of electrically conductive material and has a general semi-circular shape. The first band section 18 has a first end 22 with a projection 24 and a second end 26. The second end 26 has a stem section 28 which is provided as a semi-circular projection. The second band section 20 has a first end 30 with a mounting section 32 having a hole 34, and a second end 36. The second end 36 has a stem section 38 which is provided as a semi-circular projection. The projection 24 is sized and shaped to be inserted into the hole 34 and make an interlocking connection of the two first ends 22, 30 to each other. The two stem sections 28, 38 are sized and shaped to mate with each other and form a column shaped projection from the band. When the first ends 22, 30 and second ends 26, 36 are connected to each other, the center spans 40, 42 of the two band sections 18, 20 form a closed ring. The size of the inner diameter or aperture is specifically designed to be the same or slightly smaller than the outer diameter of the pipe 12. Therefore, when the band 14 is attached around the pipe 12, it makes a tight mechanical fit therewith as well as an electrical connection. Different size bands would be used for pipes with different outer diameters. In an alternate embodiment, the band could be a one piece member with the two stem sections 28, 38 on opposite ends. In other alternate embodiments, any suitable type or shape of first end connections could be provided, any suitable type or shape of second end stem sections could be provided, and/or more than two band sections could be used.

Figure 3:
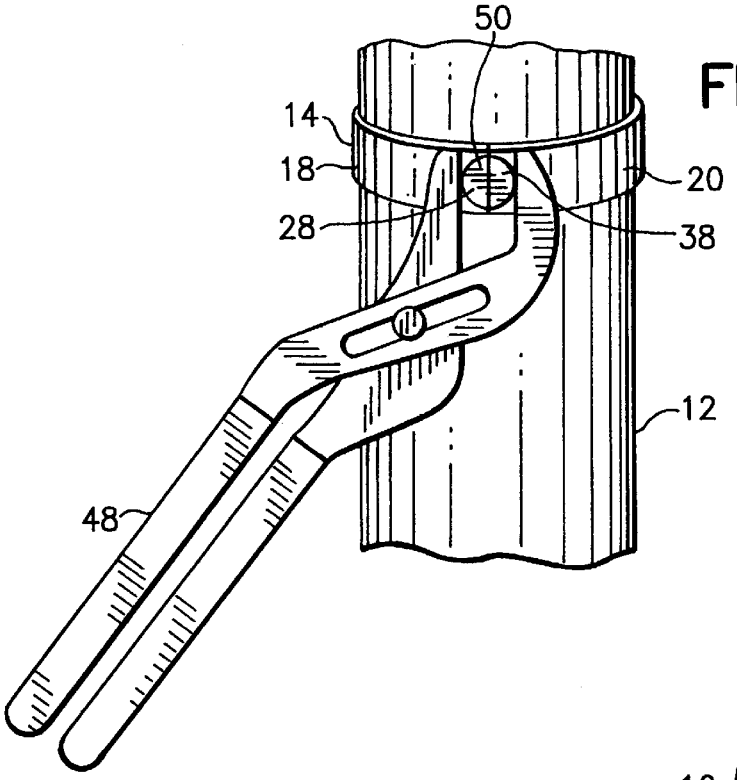
FIG. 3 is an elevational side view showing the band of FIG. 2 being initially placed on the pipe.
Figure 4:
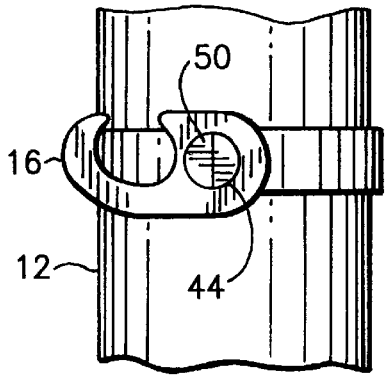
FIG. 4 is an elevational side view of the pipe and band shown in FIG. 3 with the electrical compression connector attached to the stem of the band.
Figure 5:
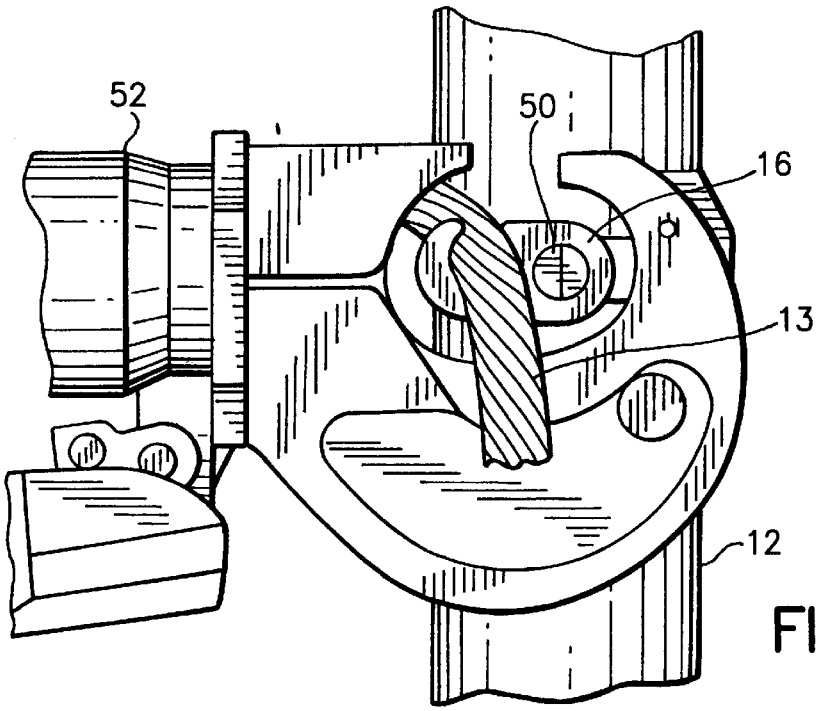
FIG. 5 is an elevational side view of the components shown in FIG. 4 with an electrical conductor located in the compression connector and a hydraulic compression tool being located at the compression connector for compressing the connector onto the electrical conductor and the stem of the band.

The compression connector 16 is a one-piece metal electrical compression connector, such as a BURNDY type YGHP-C or YGHR-C connector. BURNDY is a registered trademark of Framatome Connectors USA Inc. However, in alternate embodiments other suitable types of compression connectors could be used. The connector 16 has two apertures 44, 46. In this embodiment the first aperture 44 is a closed sided through-hole and the second aperture 46 is an open sided through-hole. The stem halves 28, 38 of the band 14, when placed against each other, are sized and shaped to be matingly received in the first aperture 44 of the compression connector 16. The second aperture 46 is sized and shaped to receive an end of the conductor 13 therein. Referring also to FIGS. 3–5, connection of the conductor 13 to the pipe 12 by the connector 10 will be described. The two first ends 22, 30 of the band halves 18, 20 are connected to each other to form a hinge. The band 14 is then placed around the pipe 12. A user uses a tool, such as the pliers 48 to compress the two second end stem sections 28, 38 against, or at least closely towards, each other. The two stem sections 28, 38 thus form a single stem 50 onto which the compression connector 16 is mounted. The stem 50 is received in the first aperture 44. The tool 48 can then be removed since the compression connector 16 will retain the two stem sections 28, 38 together. The compression connector 16 can be moved to its desired final position on the stem 50 and the conductor 13 is inserted in the second aperture 46. The user then locates a compression tool 52 around the compression connector 16. The compression tool 52 is preferably a hydraulic compression tool, such as the BURNDY Y35 Hydraulic Crimping Tool, a battery powered tool, such as the BURNDY BCT500, or a power actuated tool that uses a cartridge. However, any suitable compression tool could be used. The user actuates the compression tool 52 to compress or crimp the connector 16 onto both the conductor 13 and the stem 50 at the same time. This forms a permanent mechanical and electrical connection of the conductor 13 to the pipe 12. Thus, the connection is complete.

Figure 6:
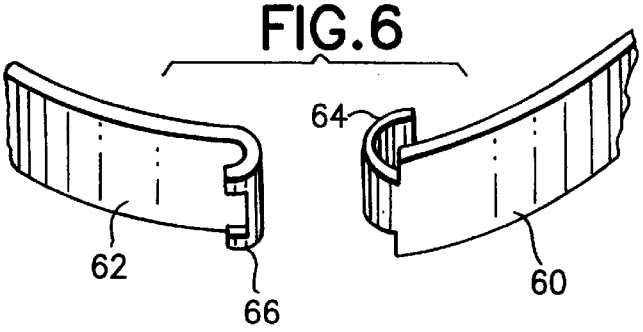
FIG. 6 is a partial perspective view of an alternate embodiment of connecting ends of the band sections.
Figure 7:
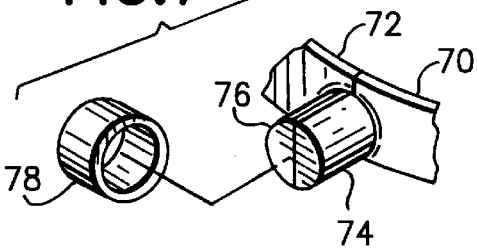
FIG. 7 is a partial perspective exploded view of another alternate embodiment of a connection of the ends of the band strips.
Figure 8:
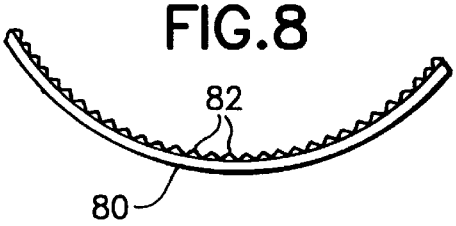
FIG. 8 is a partial top view of an alternate embodiment of the center of a band strip.
Figure 9:
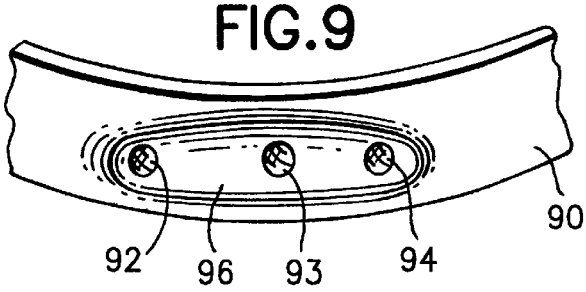
FIG. 9 is a partial perspective view of an alternate embodiment of a band strip showing a mounting section.
Figure 10:
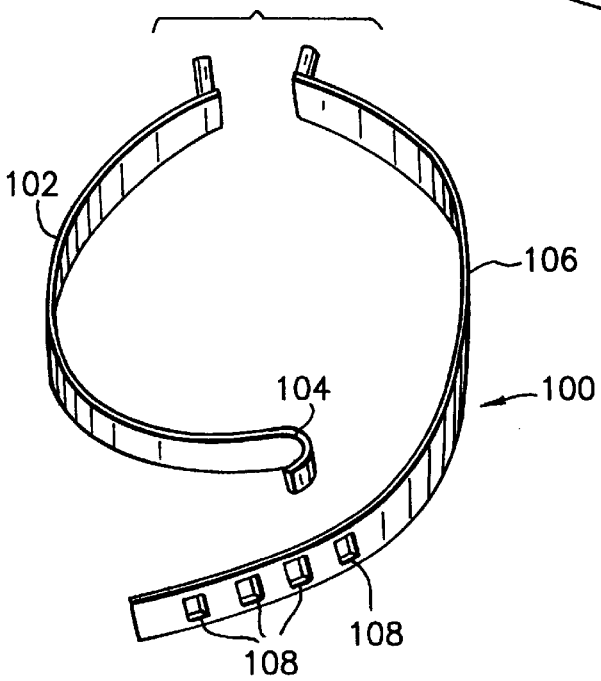
FIG. 10 is a perspective view of another alternate embodiment of the present invention.

Referring now to FIG. 6, an alternate embodiment of the first ends of the band sections is shown. In this embodiment the two first ends 60, 62 have interlocking curved clasp sections 64, 66. Referring now to FIG. 7, another alternate embodiment of the first ends of the band sections is shown. In this embodiment the two first ends 70, 72 have stud sections 74, 76 that are placed against each other. A compression sleeve 78 is then placed on the stud sections 74, 76 and compressed to thereby connect the two first ends 70, 72 to each other. Referring now to FIG. 8, an alternate embodiment of the center spans of the band sections is shown. In this embodiment the interior side of the center span 80 has barbs 82. When the band is attached to the pipe, the barbs 82 penetrate through any exterior coating on the pipe to insure a good electrical connection between the pipe and the band. Referring now to FIG. 9, another alternate embodiment of the center span of one of the band sections is shown. In this embodiment, the center space 90 has threaded holes 92, 93, 94 therein at an additional connector mounting area 96. With this embodiment, other conductors can be attached to the same band as the conductor 13. Referring now to FIG. 10, another alternate embodiment of the band is shown. In this embodiment the band 100 has a first band section 102 with a hook 104 at its first end and a second band section 106 with a plurality of holes 108 in its first end. With this embodiment the two band sections 102, 106 are adjustably connectable to each other to allow the band 100 to be connected to different size pipes. In alternate embodiments, other types of means to provide an adjustable band could be provided.

It should be understood that the foregoing description is only illustrative of the invention. Various alternative and modifications can be devices by those skilled in the art without departing from the invention. Accordingly, the present invention is intended to embrace all such alternative, modifications and variances which fall within the scope of the appended claims.

What is claimed is:

1. An electrical grounding connector for connecting a conductor to a pipe, the connector comprising:

a band comprised of electrically conductive material adapted to wrap around the pipe, the band having two end sections that form an outwardly extending stem for the band; and an electrical compression connector having at least two receiving apertures, a first one of the receiving apertures receiving the stem therein for connecting the two end sections to each other and a second one of the receiving apertures receiving the conductor therein, wherein the compression connector is compressed to fixedly attach the compression connector to the conductor and to the stem at the same time.

2. A grounding connector as in claim 1 wherein the band comprises two half band sections connected to each other at first ends, the two end sections that form the stem being located at second opposite ends.

3. A grounding connector as in claim 2 wherein the first ends have sections that interlock with each other.

4. A grounding connector as in claim 2 wherein the first ends are connected to each other by a compression sleeve.

5. A grounding connector as in claim 2 wherein the two second end sections each have a semi-circular cross-section that mate with each other.

6. A grounding connector as in claim 1 wherein the band has barbs to pierce into the pipe.

7. A grounding connector as in claim 1 wherein the compression connector is a one-piece metal member.

8. A grounding connector as in claim 7 wherein the first receiving area is a closed perimeter through hole.

9. A grounding connector as in claim 1 wherein the band includes at least one threaded hole for attaching another connector to the band.

10. An electrical grounding connector comprising:

a band comprised of electrically conductive material having at least two band sections, the band sections being connectable to each other in series for wrapping around a first electrical conductor, the at least two band sections having mating stem half sections that form a compression connector mounting section; and a one-piece deformable electrical compression connector that is attached to the compression connector mounting section of the band to attach the stem halves to each other, the compression connector having an area for receiving a second electrical conductor, wherein the compression connector can be compressed onto the compression connector mounting section and onto the second electrical conductor at the same time.

11. A grounding connector as in claim 10 wherein the band sections have first ends that are interlock connected to each other.

12. A grounding connector as in claim 11 wherein the first end of a first one of the band sections is adapted to connect to the first end of a second one of the band sections at different linear positions along the second band section.

13. A grounding connector as in claim 10 wherein the band sections have first ends that are fixedly connected to each other by a compression sleeve.

14. A grounding connector as in claim 10 wherein the band sections have barbs for piercing into the first electrical conductor.

15. A grounding connector as in claim 10 wherein the band includes at least one threaded hole for attaching another connector to the band.

16. A method of attaching a first electrical conductor to a second electrical conductor, the method comprising steps of:

connecting first ends of two half band strips to each other and placing the strips around the first conductor;

placing a one-piece electrical compression connector on a stem formed by second ends of the strips;

placing the second electrical conductor in a receiving area of the compression connector; and crimping the compression connector onto the stem and onto the second conductor.

17. A method as in claim 16 wherein the step of connecting comprises interlocking the first ends of the strips to each other.

18. A method as in claim 16 wherein second ends of the strips have stem sections that are placed against each other to form the stem.

19. A method as in claim 16 wherein the step of crimping the compression connector onto the stem and the second conductor occurs at the same time with a single crimp.

* * * * *